US005636824A

United States Patent [19]

Biasini et al.

[11] Patent Number: 5,636,824

[45] Date of Patent: Jun. 10, 1997

[54] MUSIC STAND

[75] Inventors: Americole R. Biasini, Bellingham; James R. Miller, Yakima, both of Wash.

[73] Assignee: Manhasset Specialty Co., Yakima, Wash.

[21] Appl. No.: 202,435

[22] Filed: Feb. 28, 1994

[51] Int. Cl.[6] ..... A47F 7/00

[52] U.S. Cl. ..... 248/441.1

[58] Field of Search ..... 248/441.1, 447, 248/454, 460, 462, 431, 188.5, 170

[56] References Cited

U.S. PATENT DOCUMENTS

| | | | |
|---|---|---|---|
| 1,554,538 | 9/1925 | Walberg . | |
| 2,952,485 | 9/1960 | Hammond et al. . | |
| 3,637,172 | 1/1972 | Diesbach | 248/460 |
| 4,606,525 | 8/1986 | Lombardi . | |
| 4,761,092 | 8/1988 | Nakatani | 403/104 |

FOREIGN PATENT DOCUMENTS

| | | | |
|---|---|---|---|
| 11661 | 5/1896 | United Kingdom | 248/462 |

*Primary Examiner*—Alvin C. Chin-Shue
*Assistant Examiner*—Sarah L. Purol
*Attorney, Agent, or Firm*—Stratton Ballew

[57] ABSTRACT

A music stand comprising a folding base having a clamp, a two-part vertical post, a music desk support attached to the two-part vertical post by a clamp, and a music desk attached to the music desk support.

2 Claims, 4 Drawing Sheets

MUSIC STAND

BACKGROUND OF THE INVENTION

Most music stands have a fixed base, and the music desk attachment is usually attached with a bolt and nut. This arrangement makes the music stands occupy considerable room when stored between performances.

This specification discloses a music stand having a folding leg structure, a vertical cylindrical post supported by the leg structure, a music desk support clamped to the top of the post, and a music desk bolted to the music desk support.

DETAILED DESCRIPTION OF THE INVENTION

Figure 1:
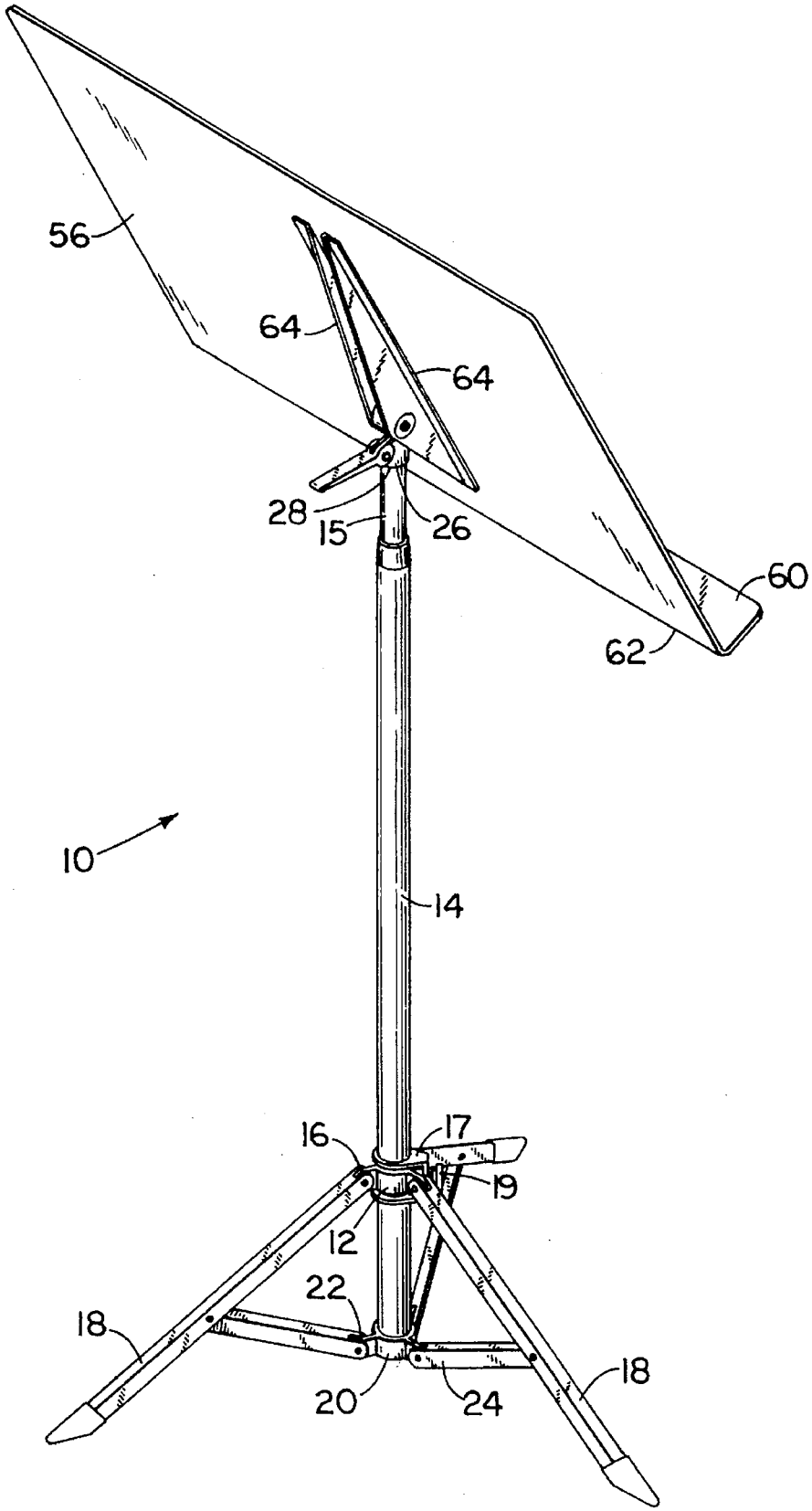
FIG. 1 is a perspective view of the music stand of this invention viewed from the back.

The music stand is indicated generally as 10 in FIG. 1. The folding leg structure has a short piece of tubing 12 vertically oriented. The internal diameter of tubing 12 is such that the vertical post 14 fits through tubing 12 with a sliding fit. Three brackets 16 are welded to the exterior of tubing 12 spaced 120 degrees apart. A leg 18 is rotatably attached to each bracket 16. Between two of the brackets 16 is a projection 17 having an internal thread. A hand screw 19 having a large turning disc is inserted into the threaded portion of projection 17. When the stand 10 is adjusted to the proper height, hand screw 19 is tightened against vertical post 14, which keeps the folding base in position, and prevents rotation of the vertical post 14 with respect to the folding stand.

Vertical post 14, which is hollow extends upward for about 30 inches. At that point it is necked down and vertical post 15 is inserted therein and extends upward. Vertical post 15 has a reasonably tight sliding fit within vertical post 14 so that the musician may adjust the height of the music desk.

A short piece of tubing 20, closed at the bottom, is vertically oriented below tubing 12. Tubing 20 has the same internal diameter as tubing 12. Three brackets 22 are welded to the exterior of tubing 20, The brackets 22 are spaced 120 degrees apart, and are located directly below brackets 16. Three limiting legs 24 are rotatably attached to brackets 22 at a first end. The second end of each limiting leg 24 is rotatably attached to the midpoint of leg 18. The limiting legs 24 prevent legs 18 from spreading too far, and insure that there is a vertical distance between tubing 12 and tubing 20 for proper support of vertical post 14.

Figure 2:
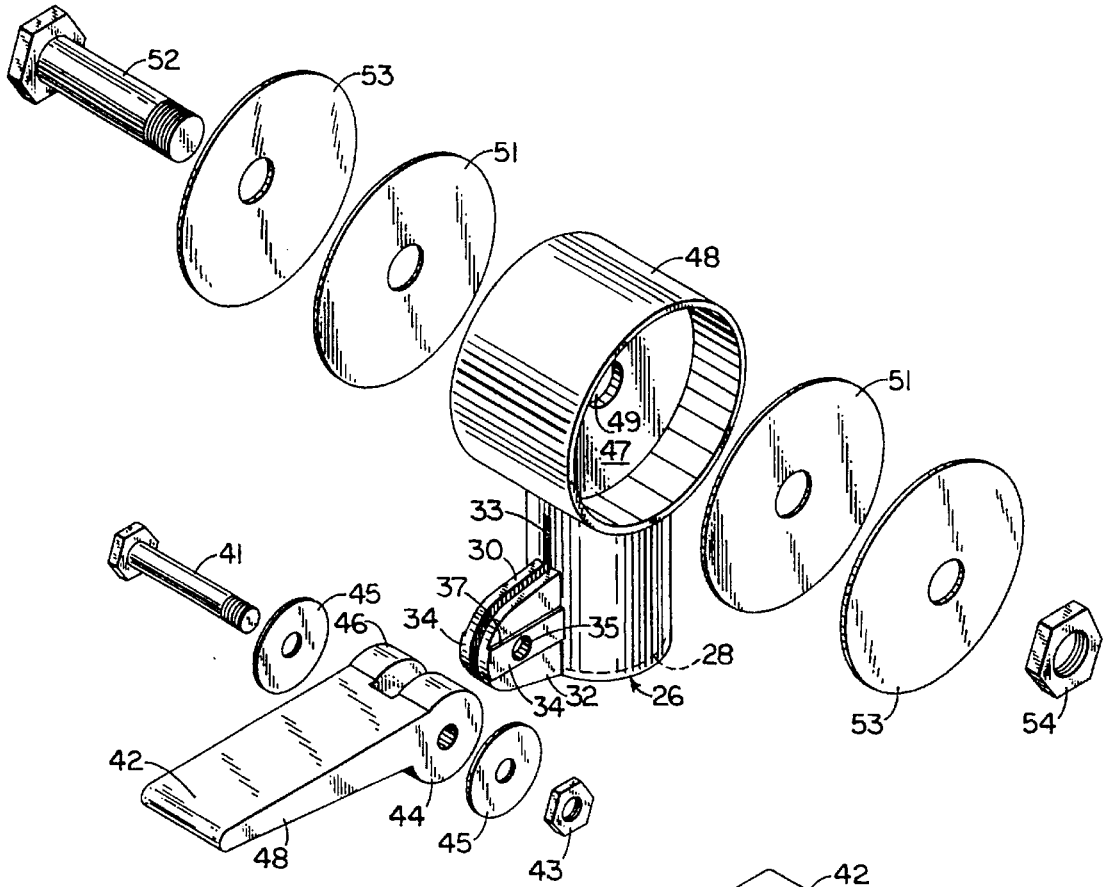
FIG. 2 is an exploded view of the music desk support and the clamping device associated therewith.
Figure 3:
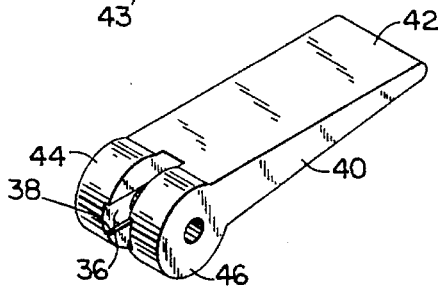
FIG. 3 is a view of the clamping handle.
Figure 2A:
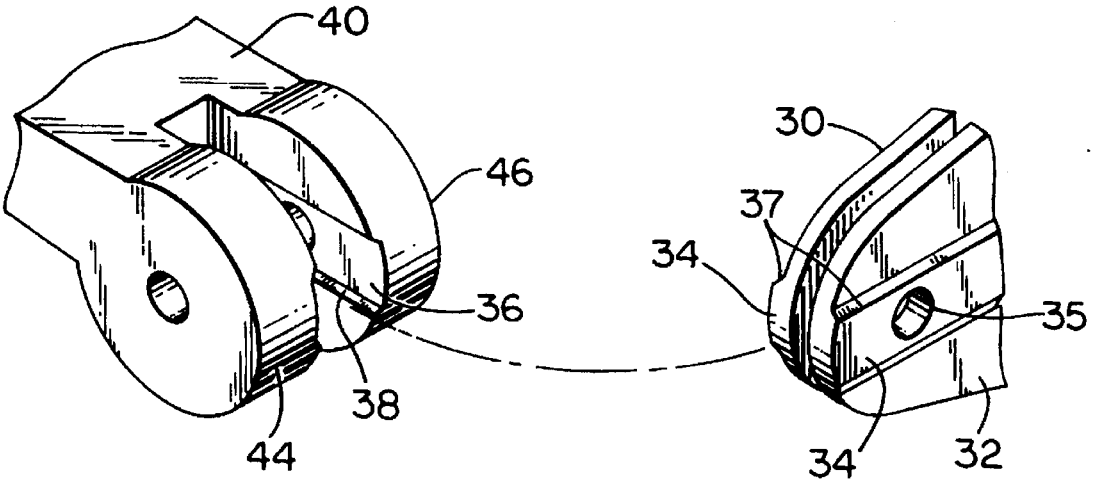

At the upper end of vertical post 15 is a clamped music desk support 26 for holding the music desk. Music desk support is illustrated in FIGS. 2 and 3. The support 26 has a cylindrical opening 28, the internal diameter of which is slightly larger than the external diameter of vertical post 15 to provide a sliding fit between the two parts. Projection 30 and projection 32, which are parallel to each other, and each of which has a centrally bored hole 35, extend perpendicularly from support 26. There is a slit 33 in support 26 between projections 30 and 32, so that cylindrical opening 28 is not a complete cylinder.

The inward facing sides of projections 30 and 32 are flat and parallel with each other. The outward sides, however, have a ramped raised portion 34 extending from the base of each projection 30 and 32 to the ends thereof.

Handle 40 has a gripping portion 42 and two projections 44 and 46 which extend perpendicularly from handle 40 and which are parallel to each other. The inward facing sides each have a recess 36, matching raised portions 34 of the projections 30 and 32, said recesses 36 extending from the base of projections 44 and 46 to the edge thereof. When handle 40 is bolted to projections 30 and 32, and the handle 40 is turned so that it is parallel to vertical post 14, the ramps of projections 30 and 32 are engaged with the ramps of projections 44 and 46, thus squeezing support 26 tight against vertical post 14, and, in effect, locking support 26 to vertical post 14. Handle 40 is secured to projections 30 and 32 by bolt 41, nut 43 and washers Atop music desk support 26 is a cylinder 48 whose axis is parallel to the center holes in projections 30 and 32. Cylinder 48 is open at each end, and has a disc 47 in the center of cylinder 48, said having a bolt hole opening 49 in the center for insertion of a bolt 52 and nut 54 to attach the music desk to the music desk support. Large washers 51 and domed washers 53 are used at the ends of cylinder 48.

The music desk 56 is a flat sheet, rather wider than it is high. One or more corrugations may run the width of music desk 56 for added strength. A shelf 60 projects from the bottom edge 62 of the music desk 56 for holding the sheet music. Two brackets 64 are attached to the back of music desk 56 from top to bottom. Brackets 64 are spaced apart a sufficient distance to enable them to fit over the length of cylinder 48. Brackets 64 are attached to cylinder 48 with bolt 52 and nut 54, so that the angle of music desk 56 may be adjusted to suit the musician.

Figure 4:
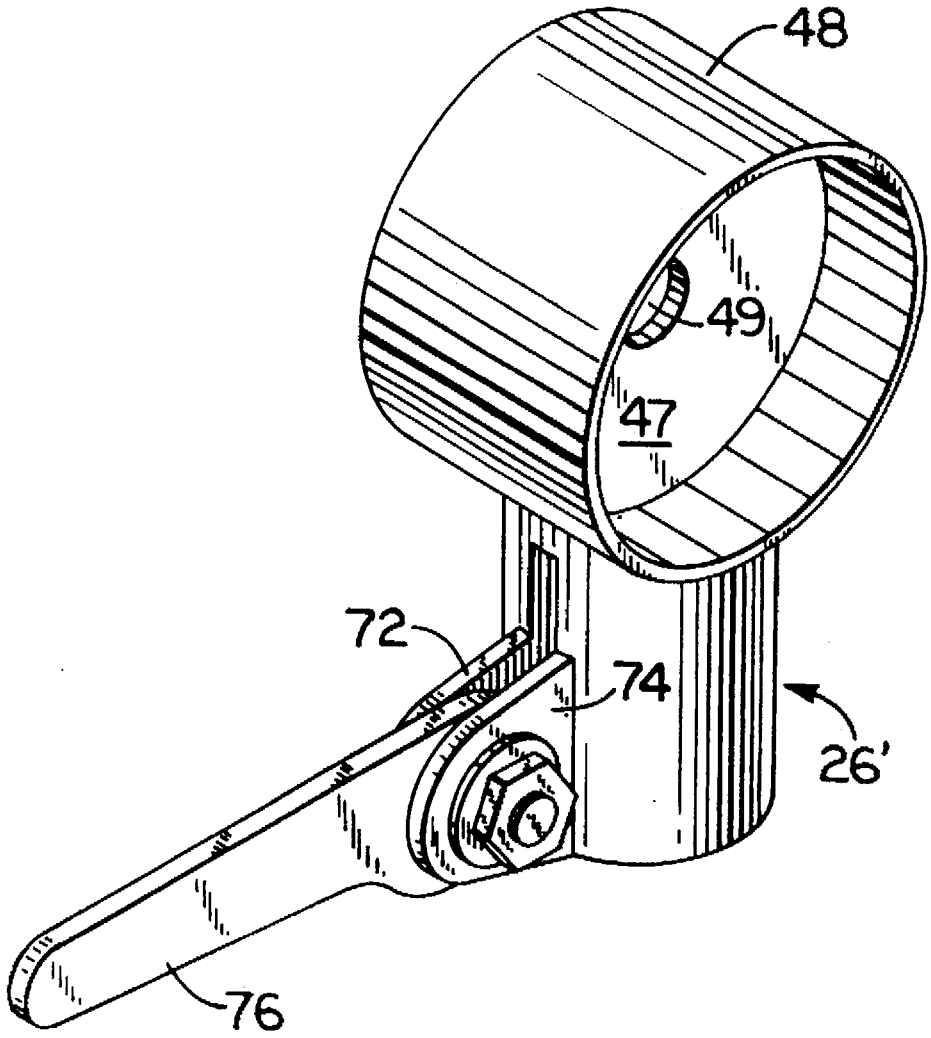
FIG. 4 is a view of an alternate clamping device.

An alternate method of attaching a music desk support 26 to vertical post 14 is illustrated in FIG. 4. The support is built in the same manner as described above, but an eccentric handle 76 is fitted between alternatively constructed projections 72 and 74. The eccentric portion of handle 76 is made by drilling its bolt hole (not shown) just off center toward the outside of handle 76. This provides a cam effect so that when handle 76 is rotated downward, the eccentric portion is forced against vertical post 15, thus holding the music desk support in position against vertical post 15.

While this invention is susceptible of embodiment in different forms, the drawings and the specification illustrate preferred embodiments of the invention, with the understanding that the present disclosure is to be considered an exemplification of the principles of the invention, and the disclosure is not intended to limit the invention to the particular embodiments described.

We claim:

1. A music stand comprising:

a folding base;

a two-part vertical column supported by the folding base;

a music desk support atop the two-part vertical column, said music desk support including a quick release mounting element defining a downward-facing, cylindrical opening, open at the bottom and closed at the top, said opening having an internal diameter which permits slidable engagement of said upper vertical post within the opening, said mounting element having two parallel support projections defining a lateral, external aperture between the projections contiguous with the cylindrical opening, said support projections having central bolt hole openings, and ramped raised elements on outer sides of the support projections;

a handle spanning the support projections of the mounting element, said handle having two handle projections sized and configured to laterally embrace the support projections, said handle projections having centrally located bolt holes, and ramped recesses on their inner sides complementary to the ramped raised elements on the outer sides of the support projections so that when said handle is turned parallel to the upper vertical post, the support projections are forced toward each other thus providing a non-rotatable grip of the music desk support on the upper vertical post;

a music desk attachment cylinder atop the quick release mounting element, the axis of the cylinder being aligned with the support projection bolt holes, said cylinder being open at each end and having a disc in the center of the cylinder, said disc having a centrally located bolt hole; and a music desk attached to the music desk support.

2. A music stand comprising:

a folding base;

a telescoping vertical column supported by the folding base, said vertical column including a lower vertical post and an upper vertical post, said upper vertical post slidably nested within the lower vertical post;

a music desk support having a quick release mounting clamp for removably mounting the desk support atop the vertical column, the quick release mounting clamp including a handle having an eccentric portion, said eccentric portion for engaging the upper vertical post to fix the music desk support in position when the handle is moved to a position parallel to the upper vertical post.

* * * * *